US012083645B2

(12) United States Patent
Tian et al.

(10) Patent No.: US 12,083,645 B2
(45) Date of Patent: Sep. 10, 2024

(54) MAGNETIC FIELD-ASSISTED VIBRATORY FINISHING DEVICE FOR MINUTE STRUCTURE AND FINISHING METHOD

(71) Applicant: Shandong University of Technology, Zibo (CN)

(72) Inventors: Yebing Tian, Zibo (CN); Zenghua Fan, Zibo (CN); Qiang Zhou, Zibo (CN); Cheng Qian, Zibo (CN)

(73) Assignee: Shandong University of Technology, Zibo (CN)

( * ) Notice: Subject to any disclaimer, the term of this patent is extended or adjusted under 35 U.S.C. 154(b) by 502 days.

(21) Appl. No.: 17/391,210

(22) Filed: Aug. 2, 2021

(65) Prior Publication Data

US 2022/0097194 A1 Mar. 31, 2022

(30) Foreign Application Priority Data

Sep. 25, 2020 (CN) ..... 202011022513.4

(51) Int. Cl.
*B24B 1/00* (2006.01)
*B24B 1/04* (2006.01)
(Continued)

(52) U.S. Cl.
CPC ..... *B24B 1/005* (2013.01); *B24B 1/04* (2013.01); *B24B 41/02* (2013.01); *B24B 41/04* (2013.01)

(58) Field of Classification Search
CPC ..... B24B 1/005; B24B 1/04; B24B 31/112; B24B 31/102; B24B 35/005; B24B 13/00; B24B 31/003; B24B 31/064; B24B 31/12; B24B 57/02; B24B 29/02; B24B 31/06; B24B 37/04; B24B 1/00; B24B 1/002; B24B 11/00; B24B 11/02; B24B 19/02; B24B 31/02; B24B 31/073; B24B 31/10;
(Continued)

(56) References Cited

FOREIGN PATENT DOCUMENTS

CN 109277886 A * 1/2019
CN 109623504 A * 4/2019 ..... B24B 1/005
(Continued)

OTHER PUBLICATIONS

Kordonsky et al.; KR 100335219 B1; translation (Year: 2002).*
(Continued)

*Primary Examiner* — Brian D Keller
*Assistant Examiner* — Dana Lee Poon
(74) *Attorney, Agent, or Firm* — JCIPRNET

(57) ABSTRACT

A magnetic field-assisted vibratory finishing device for a minute structure and a finishing method is provided. The device includes a rotating shaft, a workpiece clamping device, a magnetic field generating device, a vibration assisting device, a three-axis precision displacement platform and a base. The magnetic field generating device includes a baffle plate, magnetic bars and a magnetic-pole groove. The vibration assisting device includes a housing, guide fixing rods, a vibration motor, a vibration connecting plate, and compression springs. The workpiece clamping device clamps parts with a variety of structural shapes, and a frequency controller can control the motion mode of the magnetic field generating device during the finishing processing, thereby controlling the motion track of grinding material.

7 Claims, 3 Drawing Sheets

(51) Int. Cl.
*B24B 41/02* (2006.01)
*B24B 41/04* (2006.01)

(58) Field of Classification Search
CPC ..... B24B 31/108; B24B 31/116; B24B 31/16; B24B 35/00; B24B 37/005; B24B 37/013; B24B 37/042; B24B 37/048; B24B 37/07; B24B 37/08; B24B 37/34; B24B 41/007; B24B 41/04; B24B 41/06; B24B 41/061; B24B 47/12; B24B 49/08; B24B 49/10; B24B 49/105; B24B 49/12; B24B 49/14; B24B 7/228; B23Q 1/34; B23Q 1/0027; B23Q 1/36; B23Q 15/013; B24C 1/08; B24C 3/065; B24C 3/26; B24C 7/0092; B24D 99/00; B25H 5/00; C09K 3/1409; C09K 3/1463; C09K 3/1472; H01F 1/447; H01L 21/306; H01L 21/30625; H01L 21/31053; H01L 21/32115; Y10T 428/24479
USPC ..... 438/693; 51/307; 216/88; 134/1, 26, 6, 134/7
See application file for complete search history.

(56) References Cited

FOREIGN PATENT DOCUMENTS

| | | | | |
|---|---|---|---|---|
| CN | 110238712 A | * | 9/2019 | |
| CN | 110480427 A | * | 11/2019 | |
| CN | 111230602 A | * | 6/2020 | ..... B24B 1/005 |
| KR | 100335219 B1 | * | 11/2022 | |

OTHER PUBLICATIONS

Feng J; CN 110238712 A; translation (Year: 2019).*
Chen R; CN 109277886 A; translation (Year: 2019).*
Li S; CN 110480427 A; translation (Year: 2019).*
Han B; CN 111230602 A; translation (Year: 2020).*
Chen X; CN 109623504 A; translation (Year: 2019).*

* cited by examiner

MAGNETIC FIELD-ASSISTED VIBRATORY FINISHING DEVICE FOR MINUTE STRUCTURE AND FINISHING METHOD

CROSS REFERENCE TO RELATED APPLICATION

This application claims priority to Chinese Application No. 202011022513.4, filed on Sep. 25, 2020, the content of which is incorporated herein by reference in its entirety.

TECHNICAL FIELD

The present disclosure relates to magnetic field-assisted finishing technologies for minute structured surfaces, and more specifically, to a magnetic field-assisted vibratory finishing device for a minute structure and a finishing method.

BACKGROUND ART

Surfaces of a minute structure are a kind of minute structured surface having the regular periodic array, such as groove array, minute lens array, pyramid array and so on, which can realize the special function of optics, physics, biology and so on. Because the surface roughness of the surfaces of the minute structure is closely related to the service life of the minute structure, the appearance of the product, and the convenience or un-convenience of installation and use, polishing, as the last processing step, is becoming more and more important. It is of practical significance to improve the polishing of such surfaces and similar surfaces. Minute structured surface polishing technologies have applied to the overseas production processes, mainly including mechanical polishing, ultrasonic polishing, electrochemical polishing, ultrasonic electro-chemical polishing, and abrasive flow polishing and so on. In recent years, some devices have been introduced and used, and some new technologies have been developed. These polishing methods can partly solve the problem that minute structured surfaces are difficult to polish, whereas the methods have some shortcomings in some specific aspects. For example, the electrochemical polishing is difficult to obtain high machining accuracy and machining stability, and the phenomenon of stray corrosion is serious during machining. Ultrasonic polishing is used for machining non-conductive hard and brittle materials, and when machining metal materials that are conductive and hard, the production efficiency is low and the effect is not good enough. The ultrasonic electro-chemical composite polishing technology is limited when machining conductive material because the removal of workpiece material is realized by electro-chemical machining. According to the domestic and international research reports, the magnetic field-assisted ultra-precision machining technology can solve many problems in traditional polishing by utilizing the flexibility and controllability of free grinding material, which concerns mainly the magnetorheological polishing technology, the magnetorheological jet polishing technology, and the magnetic float polishing technology and so on. However, the magnetic field-assisted ultra-precision machining technology is difficult to machine the grooves, recesses and slots having minute structures due to the limit of the size of the tool. Therefore, on the basis of analyzing magnetic shear thickening characteristics, there exists the important research value and development prospect that the magnetorheological polishing and magnetic field-assisted precision machining are combined to solve the problem of finishing the minute structured surfaces. The present disclosure provides a magnetic field-assisted vibratory finishing device for a minute structure and a finishing method. The surface finishing of the minute structure can be realized by integrating the novel magnetic field generating device, the rotation of a workpiece clamping device, and the position movement of the three-axis precision displacement platform. The finishing efficiency is improved by controlling the amplitude of vibration.

SUMMARY

The present disclosure provides a magnetic field-assisted vibratory finishing device for a minute structure and a finishing method. Magnetic pole bars are arranged in the magnetic-pole groove to form a magnetic field generating device. The magnetic field generating device is arranged on the vibration connecting plate. The vibration motor is arranged under the vibration connecting plate. Four guide fixing rods keep the vibration connecting plate vibrating up and down. By adjusting the working mode of the vibration motor by the frequency controller, the motion mode of the magnetic field generating device and the distance between the magnetic field generating device and the part to be processed during the finishing process can be controlled, thereby controlling the motion track of the grinding material, which can realize the finishing of the parts, which are minute structures, of different sizes, and improve the processing efficiency.

A magnetic field-assisted vibratory finishing device for a minute structure is provided. The magnetic field-assisted vibratory finishing device comprising a rotating shaft, a workpiece clamping device, a magnetic field generating device, a vibration assisting device, a three-axis precision displacement platform and a base; wherein, the magnetic field generating device comprises a baffle plate, magnetic bars, a magnetic-pole groove, hexagon bolts and nuts; the vibration assisting device comprises a housing, guide fixing rods, a vibration motor, a vibration connecting plate and compression springs; the baffle plate is connected to the magnetic-pole groove by a clearance fit; the magnetic-pole groove with the magnetic bars is fixedly connected to the vibration connecting plate through the hexagon bolts and the nuts; the vibration connecting plate is provided on the guide fixing rods each of which is mounted with a corresponding one of the compression springs, and the vibration motor is provided inside the housing; the housing is fixed on the three-axis precision displacement platform; and one end of the workpiece clamping device is connected to a part to be processed and another end of the workpiece clamping device is configured to be connected to the rotating shaft.

The advantages of the embodiments are as follows. First, in a magnetic field-assisted vibratory finishing device for a minute structure and a finishing method, the part to be processed is fixed on the workpiece clamping device, which can complete the clamping and finishing of minute structures of different shapes and of different sizes, and has the wide operability. Second, in the magnetic field-assisted vibratory finishing device for a minute structure and the finishing method, the vibration motor is located directly below a center of the magnetic field generating device to ensure that the exciting force applied to the magnetic field generating device is uniform and equal. Third, in the magnetic field-assisted vibratory finishing device for a minute structure and the finishing method, by adjusting the working mode of the vibration motor through a frequency controller, during the process of finishing, the motion mode of the magnetic field generating device and the distance between the magnetic field generating device and the part to be processed can be regulated and controlled, and further the motion track of the grinding material can be controlled, so that the finishing of the parts of different sizes can be realized. Fourth, in the magnetic field-assisted vibratory finishing device for a minute structure and the finishing method, the guide fixing rods can ensure the vertical movement of the magnetic field generating device, thereby promoting the magnetic finishing medium entering into the minute structure uniformly, and forcing the damaged grinding grains to be replaced, which enhances the relative motion between the magnetic finishing medium and the minute structure, and improves the processing efficiency. Fifth, in the magnetic field-assisted vibratory finishing device for a minute structure and the finishing method, by selecting different arrangement modes for the magnetic bars in the slots, different distributions of magnetic field lines can be generated, and different types of flexibly fixed abrasive tools can be produced, which can meet the requirements of finishing the parts, which are minute structures, of different sizes.

DETAILED DESCRIPTION OF THE EMBODIMENTS

Figure 1:
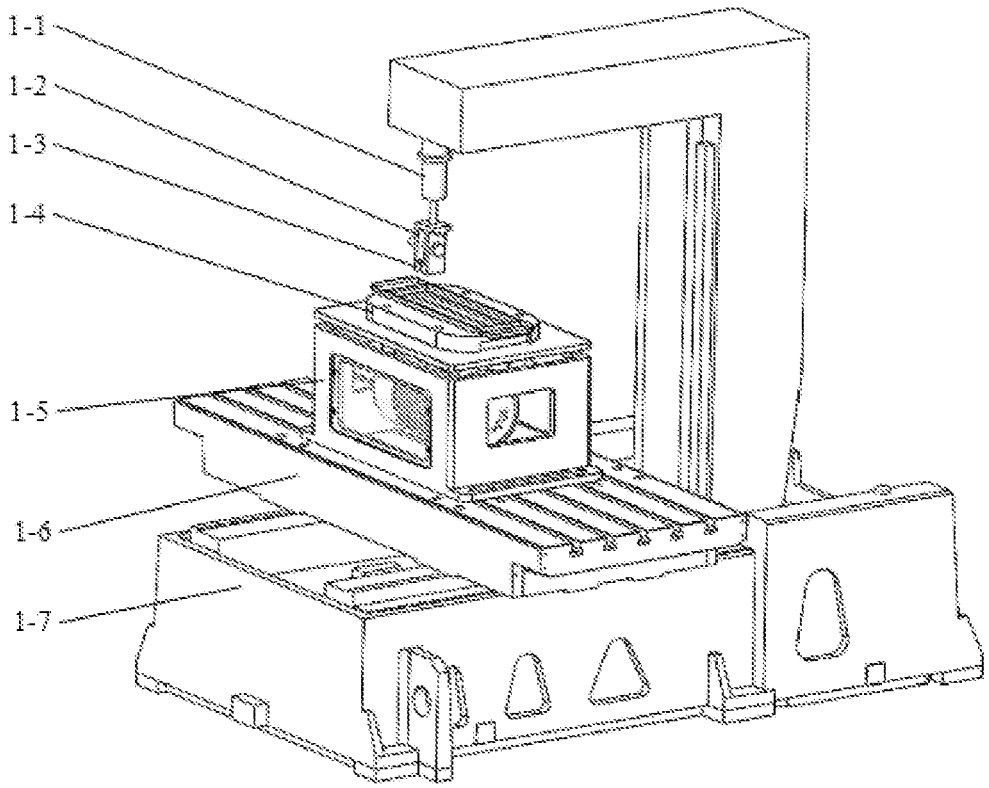
FIG. 1 is a schematic diagram showing an overall structure of a magnetic field-assisted vibratory finishing device for a minute structure according to an embodiment of the present disclosure.
Figure 2:
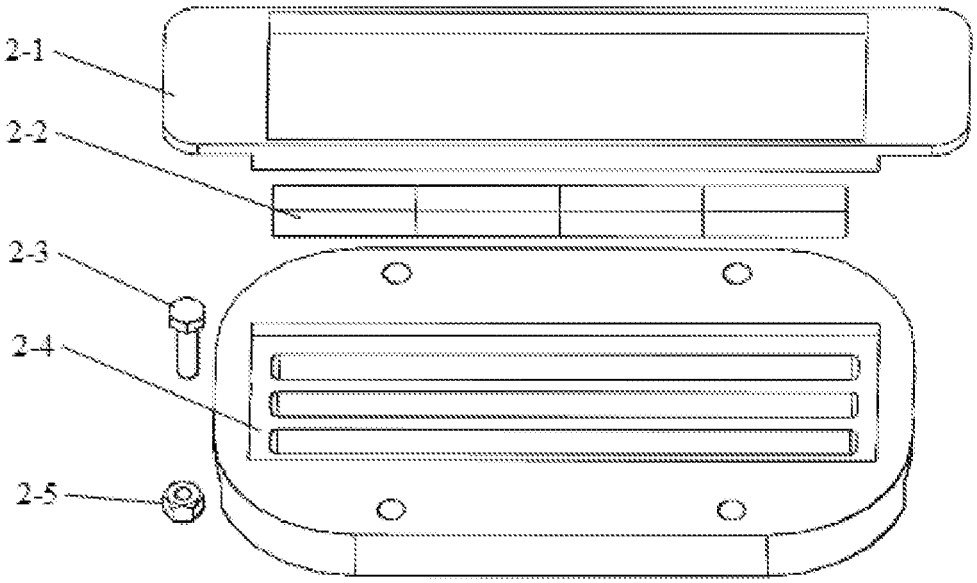
FIG. 2 is a schematic structural diagram of a magnetic field generating device of a magnetic field-assisted vibratory finishing device for a minute structure according to an embodiment of the present disclosure.
Figure 3:
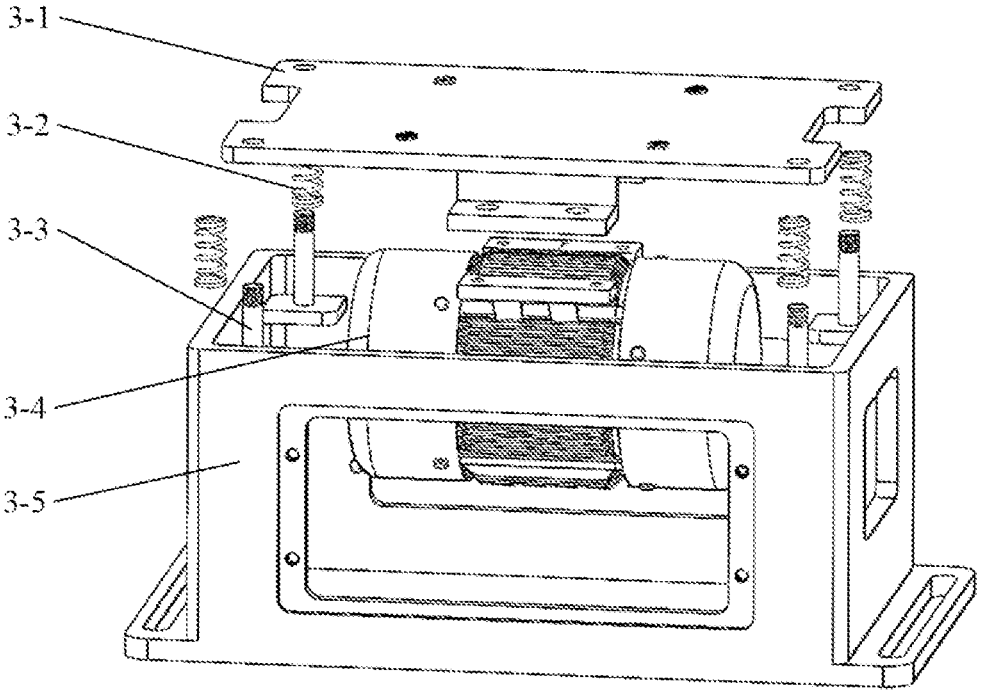
FIG. 3 is a schematic structural diagram of a vibration assisting device of a magnetic field-assisted vibratory finishing device for a minute structure according to an embodiment of the present disclosure.

In a first example, referring to FIGS. 1-3, the device of the embodiment includes a rotating shaft 1-1, a workpiece clamping device 1-2, a magnetic field generating device 1-4, a vibration assisting device 1-5, a three-axis precision displacement platform 1-6 and a base 1-7. The magnetic field generating device 1-4 includes a baffle plate 2-1, magnetic bars 2-2, a magnetic-pole groove 2-4, hexagon bolts 2-3 and nuts 2-5. The vibration assisting device 1-5 includes a housing 3-5, guide fixing rods 3-3, a vibration motor 3-4, a vibration connecting plate 3-1 and compression springs 3-2. The baffle plate 2-1 is connected to the magnetic-pole groove 2-4 by a clearance fit. The magnetic-pole groove 2-4 that are mounted with the magnetic bars 2-2 is fixedly connected to the vibration connecting plate 3-1 through the hexagon bolts 2-3 and the nuts 2-5. The vibration connecting plate 3-1 is provided on the guide fixing rods 3-3 each of which is provided with the compression spring 3-2, and the vibration motor 3-4 is provided inside the housing 3-5. The housing 3-5 is fixed on the three-axis precision displacement platform 1-6 and one end of the workpiece clamping device 1-2 is configured to be connected to a part 1-3 to be processed and another end thereof is connected to the rotating shaft 1-1.

In a second example, the magnetic-field assisted vibratory finishing device for the minute structure and a finishing method in this embodiment will be described with reference to FIG. 1. The rotating shaft 1-1 drives the workpiece clamping device 1-2 to rotate, and the part 1-3 to be processed can be rotated at high speed and moved. The rotating shaft 1-1 may be selected a 6-sps robot, and the others of the second example are the same as those in the first example.

In a third example, referring to FIG. 1 and FIG. 3, a working mode of the vibration motor 3-4 is adjusted by a frequency controller, and thus during the finishing processing, the movement mode of the magnetic field generating device 1-4 and a distance between the magnetic field generating device 1-4 and the part 1-3 to be processed are controlled, so as to control a moving track of grinding material, so that a finishing of the parts, which are the minute structures, of different sizes, is realized. The guide fixing rods 3-3 can ensure the vertical movement of the magnetic field generating device 1-4, thereby promoting the magnetic finishing medium entering into the minute structure uniformly, and forcing the damaged grinding grains to replace. The relative motion between the magnetic finishing medium and the minute structure is enhanced, and the processing efficiency is improved. The others of the third example are the same as those in the first example or second example.

In a fourth example, referring to FIG. 1 and FIG. 3, the vibration motor 3-4 of the disclosure is located directly below a center of the magnetic field generating device 1-4. The exciting force that is applied to the magnetic field generating device 1-4 in the disclosure is ensured to be uniform and equal, and the others of the fourth example are the same as those of in the first, second or third example.

Figure 4A:
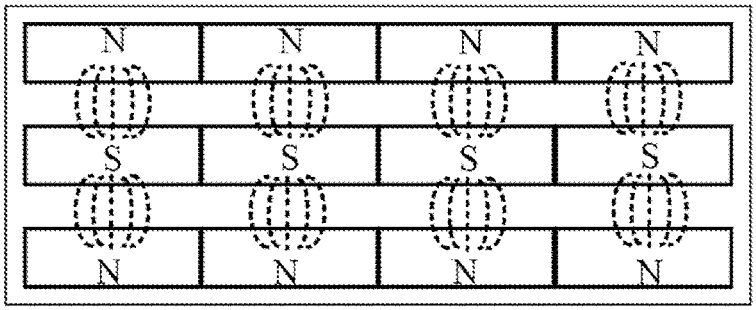
FIG. 4A is a schematic diagram of a partial pole arrangement with eight magnetic flux lines in a magnetic field generating device of a magnetic field-assisted vibratory finishing device for a minute structure according to an embodiment of the present disclosure.
Figure 4B:
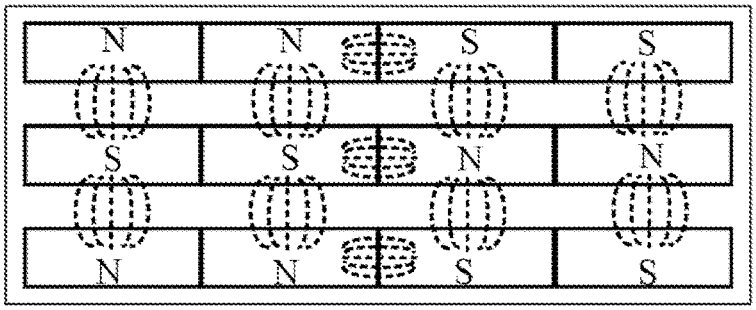
FIG. 4B is a schematic diagram of a partial pole arrangement with eleven magnetic flux lines in a magnetic field generating device of a magnetic field-assisted vibratory finishing device for a minute structure according to an embodiment of the present disclosure.
Figure 4C:
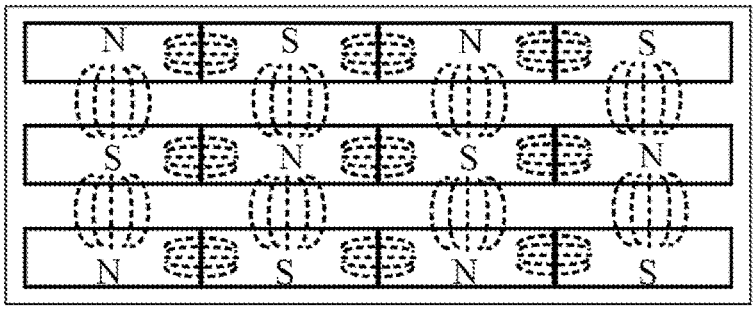
FIG. 4C is a schematic diagram of a partial pole arrangement with fourteen magnetic flux lines in a magnetic field generating device of a magnetic field-assisted vibratory finishing device for a minute structure according to an embodiment of the present disclosure.
Figure 4D:
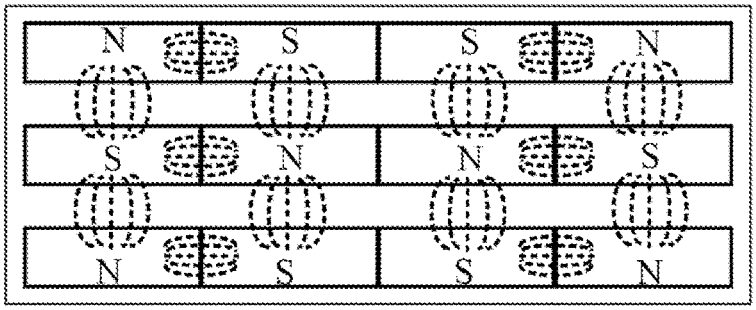
FIG. 4D is a schematic diagram of a partial pole arrangement with seventeen magnetic flux lines in a magnetic field generating device of a magnetic field-assisted vibratory finishing device for a minute structure according to an embodiment of the present disclosure.

In a fifth example, referring to FIG. 2, distributions of different magnetic field lines are generated by changing different arrangements of the magnetic bars 2-2. The magnetic-pole groove 2-4 have three rows of slots in total, four magnetic bars 2-2 can be placed in each row of slot, and based on the alternating magnetic field formed by different arrangements of N poles and S poles, various distributions of magnetic field lines can be generated. By changing the arrangements of the magnetic bars placed in three rows of slots, for example, eight magnetic flux lines (as shown in FIG. 4A), eleven magnetic field lines (as shown in FIG. 4B), fourteen magnetic field lines (as shown in FIG. 4C) and seventeen magnetic field lines (as shown in FIG. 4D) can be generated respectively. The magnetic finishing medium is distributed along the magnetic field lines on the upper surface of the baffle plate to form a flexibly fixed abrasive tool, which can satisfy the finishing processing of parts, which are the minute structures, of different characters. The others of the fifth example are the same as those in the first, second, third or fourth example.

In a sixth example, referring to FIGS. 1-4, the finishing method is performed by the device in any one of the above examples as follows.

In step 1, a part 1-3 to be processed is mounted on a workpiece clamping device 1-2.

In step 2, a magnetic finishing medium is placed on a baffle plate 2-1 of the magnetic field generating device 1-4, to form protrusions that are a flexibly fixed abrasive tool under the action of the magnetic field lines.

In step 3, different distributions of magnetic field lines are generated through the different arrangements of the magnetic bars 2-2, so as to produce the flexibly fixed abrasive tool of a different type for meeting the requirements of the finishing of parts which are minute structures, of different characters.

In step 4, by the rotating shaft 1-1 and the three-axis precision displacement platform 1-6, the workpiece clamping device 1-2 is adjusted to a finishing area of the magnetic field generating device 1-4, and the part 1-3 to be processed is adjusted to be in flexible contact with the flexibly fixed abrasive tool formed by the magnetic finishing medium.

In step 5, a driving signal is applied to a vibration motor 3-4, and a vibration in the axial direction of the magnetic field generating device 1-4 is generated.

In step 6, a relative movement between the flexibly fixed abrasive tool and a surface of the part 1-3 to be processed is enabled by means of vibration of the vibration assisting device 1-5 and in combination with rotation of the part 1-3 to be processed, and a feed movement of the three-axis precision displacement platform 1-6, so as to perform the finishing processing.

In step 7, by a frequency controller, a working mode of the vibration motor 3-4 is adjusted to control the movement mode of the magnetic field generating device 1-4, a distance between the magnetic field generating device 1-4 and the part 1-3 to be processed, and in turn a moving track of grinding material during the finishing process, so that the parts, which are the minute structures, of different characters, are subjected to the finishing processing.

What is claimed is:

1. A magnetic field-assisted vibratory finishing device for a minute structure, the magnetic field-assisted vibratory finishing device comprising:

a rotating shaft;

a workpiece clamping device;

a magnetic field generating device;

a vibration assisting device;

a three-axis precision displacement platform; and a base;

wherein, the magnetic field generating device comprises:

a baffle plate;

magnetic bars, comprising N poles and S poles;

a magnetic-pole groove;

hexagon bolts and nuts;

wherein the vibration assisting device comprises:

a housing;

guide fixing rods;

a vibration motor;

a vibration connecting plate; and compression springs;

wherein:

the baffle plate is connected to the magnetic-pole groove by a clearance fit;

the magnetic-pole groove with the magnetic bars is fixedly connected to the vibration connecting plate through the hexagon bolts and the nuts;

the vibration connecting plate is provided on the guide fixing rods each of which is mounted with a corresponding one of the compression springs;

the vibration motor is provided inside the housing, wherein the housing is fixed on the three-axis precision displacement platform; and one end of the workpiece clamping device is configured to be connected to a part to be processed and another end of the workpiece clamping device is connected to the rotating shaft.

2. The magnetic field-assisted vibratory finishing device for the minute structure of claim 1, wherein a shape of the part to be processed, which is clamped on the workpiece clamping device, is cylindrical, cubic or semicircular.

3. The magnetic field-assisted vibratory finishing device for the minute structure of claim 1, wherein, by adjusting an operation mode of the vibration motor through a frequency controller, a movement mode of the magnetic field generating device, and a distance between the magnetic field generating device and the part to be processed are adjusted and controlled.

4. The magnetic field-assisted vibratory finishing device for the minute structure of claim 1, wherein the guide fixing rods are perpendicular to the vibration connecting plate and provided in the housing to drive the magnetic field generating device to move in an axial direction thereof.

5. The magnetic field-assisted vibratory finishing device for the minute structure of claim 1, wherein the vibration motor is provided directly below a center of the magnetic field generating device for ensuring that an exciting force applied to the magnetic field generating device is uniform and equal.

6. The magnetic field-assisted vibratory finishing device for the minute structure of claim 1, wherein different distributions of magnetic field lines are generated by arrangements of the N poles and the S poles of the magnetic bars; the magnetic-pole groove comprises three rows of slots each of which is provided with four of the magnetic bars; the N poles and the S poles of the magnetic bars in the three rows of slots are changed in arrangement.

7. A method of finishing by the magnetic field-assisted vibratory finishing device for the minute structure according to claim 1, wherein the method comprises:

mounting the part to be processed on the workpiece clamping device;

placing a magnetic finishing medium on the baffle plate of the magnetic field generating device, to form protrusions by means of the magnetic field lines;

generating the different distributions of magnetic field lines by different arrangements of the N poles and the S poles of the magnetic bars so as to produce the protrusions of a different type for meeting a finishing processing of parts, which are minute structures, of different characters;

adjusting, by the rotating shaft and the three-axis precision displacement platform, the part to be processed to a finishing area of the magnetic field generating device, and adjusting the part to be processed to be in flexible contact with the protrusions formed by the magnetic finishing medium;

applying a driving signal to the vibration motor, and generating a vibration in an axial direction of the magnetic field generating device;

enabling a relative movement between the protrusions and a surface of the part to be processed by means of vibration of the vibration assisting device and in combination with rotation of the part to be processed, and a feed movement of the three-axis precision displacement platform, so as to perform the finishing processing; and adjusting, by a frequency controller, a working mode of the vibration motor, so as to control a movement mode of the magnetic field generating device, a distance between the magnetic field generating device and the part to be processed, and in turn a moving track of grinding material during the finishing processing, such that parts, which are minute structures, of different characters, are subjected to the finishing processing.

* * * * *